US005835824A

United States Patent [19]

Shinohara et al.

[11] Patent Number: 5,835,824

[45] Date of Patent: Nov. 10, 1998

[54] EXPOSURE DEVICE IN AN IMAGE-FORMING MACHINE

[75] Inventors: Masahiro Shinohara; Akihiro Ozaki, both of Osaka, Japan

[73] Assignee: Mita Industrial Co., Ltd., Osaka, Japan

[21] Appl. No.: 827,601

[22] Filed: Mar. 28, 1997

[30] Foreign Application Priority Data

Mar. 30, 1996 [JP] Japan ..... 8-103765
Mar. 30, 1996 [JP] Japan ..... 8-103766

[51] Int. Cl.[6] ..... G03G 15/04; G03G 15/28; G03G 15/30

[52] U.S. Cl. ..... 399/211; 399/212; 359/813

[58] Field of Search ..... 399/130, 177, 399/206, 211, 118; 359/811, 813, 819, 698, 703

[56] References Cited

U.S. PATENT DOCUMENTS 4,806,989 2/1989 Saito et al. ..... 399/206 X
5,465,126 11/1995 Fukuda ..... 359/813 X

*Primary Examiner*—Arthur T. Grimley
*Assistant Examiner*—Hoan Tran
*Attorney, Agent, or Firm*—Antonelli, Terry, Stout & Kraus, LLP

[57] ABSTRACT

An exposure device in an image-forming machine, in which an optical lens unit is able to reciprocatingly move in the direction of the optical axis, and the image of a document is exposed to the photosensitive surface of a photosensitive material through the optical lens unit. The optical lens unit includes a lens-holding plate which is able to reciprocatingly move in the direction of the optical axis, a lens center-adjusting plate which is disposed on the lens-holding plate so as to pivot on a positioning vertical shaft and so as to be secured, a lens mounted on the lens center-adjusting plate, and a light quantity correction plate which is mounted on the lens center-adjusting plate so as to move in the radial direction relative to the center of the lens. A guide member is provided for moving the light quantity correction plate in the radial direction relative to the center of the lens with the reciprocating motion of the lens-holding plate in the direction of optical axis.

8 Claims, 8 Drawing Sheets

EXPOSURE DEVICE IN AN IMAGE-FORMING MACHINE

FIELD OF THE INVENTION

The present invention relates to an exposure device mounted in an image-forming machine such as electrostatic copying machine, an electrostatic printing machine or the like.

DESCRIPTION OF THE PRIOR ART

An exposure device for an image-forming machine comprises a first moving frame having a source of light to which the document will be exposed, a slit for exposure, and a mirror by which light reflected from the surface of the document through the slit for exposure is projected in a predetermined direction; a second moving frame mounting a mirror which projects, in a predetermined direction, light projected from the mirror mounted on the first moving frame; a stationary mirror which projects light projected from the mirror mounted on the second moving frame onto the photosensitive surface of a photosensitive material drum; and an optical lens unit disposed between the second moving frame and the stationary mirror.

In the thus constituted exposure device, the optical lens unit is permitted to reciprocatingly move in the direction of the optical axis so that the magnification of the projection can be changed to obtain a copy at a decreased scale or a copy at an increased scale. In the exposure device equipped with a so-called magnification varying function which enables the magnification of projection to be varied, the distribution of the quantity of image light on the photosensitive surface of the photosensitive material drum becomes nonuniform in the lengthwise direction of the slit exposure area with the motion of the optical lens unit in the direction of optical axis. That is, when the optical lens unit is moved away from the image of the document in order to form an electrostatic latent image at a decreased scale on the photosensitive surface of the photosensitive material drum, the quantity of image light on the photosensitive surface increases toward both sides of the slit exposure area in the lengthwise direction thereof. When the image at a decreased scale is formed, therefore, both the right side and the left side of the transferred image (both sides of the exposed area in the lengthwise direction) become brighter than occurs when the scale of the image a scale that is not changed. When the optical lens unit is moved to approach the image of the document in order to form an electrostatic latent image at an increased scale on the photosensitive surface of the photosensitive material drum, the quantity of image light on the photosensitive surface decreases toward both sides of the slit exposure area in the lengthwise direction thereof. When the image at an expanded scale is formed, therefore, both the right side and the left side of the transferred image become darker than occurs when the scale of the image that is not changed. In order to correct the change in the distribution of the quantity of image light on the photosensitive surface, that is caused by the motion of the optical lens unit in the direction of the optical axis, the exposure device having a magnification varying function has been provided with a light quantity correction means which makes the quantity of projected light on the slit exposure area uniform in the lengthwise direction thereof.

The light quantity correction means is equipped with a light quantity correction plate which is arranged on the front side or on the back side of the lens and becomes taller toward both the right and left sides, the light quantity correction plates being allowed to move in the radial direction relative to the center of the lens with the motion of the optical lens unit in the direction of the optical axis.

In the above-mentioned exposure device, there takes place a so-called "one-side focusing" unless the optical lens unit is disposed between the contact glass on which the document will be placed and the photosensitive drum in parallel therewith and at right angles with the optical axis of the reflected light. In order to prevent the occurrence of "one-side focussing", the optical lens unit is so constituted that a lens frame mounting the lens is turned on a vertical shaft for positioning (to be simply referred to as a positioning vertical shaft hereinafter) so that the mounting angle (direction of the center of the lens) can be adjusted.

The optical lens unit comprises a lens-holding plate disposed to move in the direction of the optical axis and a lens mounted on the lens frame disposed on the lens-holding plate, the lens frame being allowed to be turned on the positioning vertical shaft provided on the lens-holding plate so as to be adjusted, and the light quantity correction plate is mounted on the lens-holding plate to move up and down. The light quantity correction plate mounted on the lens-holding plate moves on an inclined surface of an inclined guide member arranged in the direction of motion of the optical lens unit, thereby to be allowed to move upward and downward.

Since the light quantity correction plate has been mounted on the lens-holding plate, an interval between the light quantity correction plate and the lens undergoes a change on both the right and left sides when the lens frame is turned on the positioning vertical shaft for adjusting the angle of the lens mounted on the lens-holding plate. Thus, as the positional relationship changes between the light quantity correction plate and the lens, a difference occurs in the light quantity correction on both sides of the slit exposure area in the lengthwise direction thereof.

The light quantity correction plate has two holes which are elongated in the up-and-down direction, and the plate is allowed to move up and down. Two guide pins are fitted to the lens-holding plate passing through the two elongated holes, whereby the light quantity correction plate moves on the inclined surface of the inclined guide member in the up-and-down direction, being guided by the two guide pins. In order that the light quantity correction plate smoothly moves in the up-and-down direction, light correction plate-holding members are arranged on both sides of the light quantity correction plate at the guide pin insertion portions.

In order for the light quantity correction plate to move up and down, a clearance must be maintained relative to the light quantity correction plate holding members. When the light quantity correction plate moving on the inclined surfaces of the inclined guide members is caught by the inclined guide members, the light quantity correction plate is tilted toward the front side or the rear side due to the catching. When tilted toward the front side or the rear side, the light quantity correction plate is twisted relative to the light quantity correction plate holding members and fails to smoothly move in the up-and-down direction. When the light quantity correction plate fails to smoothly move, the drive load for moving the optical lens unit in the direction of the optical axis increases, and the motor must bear a large load for moving the optical lens unit. When the motor is a stepping motor, in particular, a large load causes the motor to get out of order (motor fails to smoothly rotate). As a result, the position of the lens is deviated, and the magnification becomes quite disordered. Further, the tilting tendency of the light quantity correction plate becomes more conspicuous with an increase in the up-and-down stroke of the light quantity correction plate to improve the effect of light quantity correction, since the positions of the guide pins separate away from the inclined surfaces of the inclined guide members. Thus, the correction of the light quantity by means of moving the light quantity correction plate up and down involves a mechanical problem making it difficult to accomplish the light quantity correction to a sufficient degree.

SUMMARY OF THE INVENTION

A first object of the present invention is to provide an exposure device for an image-forming machine which is capable of adjusting the angle for mounting the lens, while maintaining a positional relationship between the light quantity correction plate and the lens.

A second object of the present invention is to provide an exposure device for an image-forming machine which is capable of smoothly moving the light quantity correction plate with the motion of the optical lens unit in the direction of optical axis.

In order to accomplish the above-mentioned first object according to the present invention, there is provided an exposure device in an image-forming machine in which an optical lens unit is able to reciprocatingly move in the direction the optical axis, and the image the document is exposed to the photosensitive surface of a photosensitive material through said optical lens unit; wherein said optical lens unit comprises a lens-holding plate which is able to reciprocatingly move in the direction of the optical axis, a lens center-adjusting plate which is disposed on said lens-holding plate so as to turn on a positioning vertical shaft and so as to be secured, a lens mounted on said lens center-adjusting plate, and a light quantity correction plate which is mounted on said lens center-adjusting plate so as to move in the radial direction relative to the center of the lens; and wherein provision is made of a guide member for moving said light quantity correction plate in the radial direction relative to the center of said lens with the reciprocating motion of said lens-holding plate in the direction of the optical axis.

In order to accomplish the above-mentioned second object according to the present invention, there is provided an exposure device in an image-forming machine, in which an optical lens unit is able to reciprocatingly move in the direction of the optical axis, and the image of the document is exposed to the photosensitive surface of a photosensitive material through said optical lens unit; wherein said optical lens unit comprises a lens-holding plate which is able to reciprocatingly move in the direction of the optical axis, a lens disposed on said lens-holding plate, and a pair of light quantity correction plates swingably supported by a pair of support shafts mounted on said lens-holding plate in the direction of the optical axis; and wherein provision is made of a guide member for swinging said pair of light quantity correction plates on said pair of support shafts with the reciprocating motion of said lens-holding plate in the direction of the optical axis.

In order to accomplish the above-mentioned first and second objects according to the present invention, furthermore, there is provided an exposure device in an image-forming machine, in which an optical lens unit is able to reciprocatingly move in the direction of the optical axis, and the image of the document is exposed to the photosensitive surface of a photosensitive material through said optical lens unit; wherein said optical lens unit comprises a lens-holding plate which is able to reciprocatingly move in the direction of the optical axis, a lens center-adjusting plate which is disposed on said lens-holding plate so as to turn on a positioning vertical shaft and so as to be secured, a lens mounted on said lens center-adjusting plate, and a pair of light quantity correction plates swingably supported by a pair of support shafts mounted on said lens center-adjusting plate in the direction of the optical axis; and wherein provision is made of a guide member for swinging said pair of light quantity correction plates on said pair of support shafts with the reciprocating motion of said lens-holding plate in the direction of optical axis.

Other objects and features of the present invention will become apparent from the following description.

DETAILED DESCRIPTION OF THE PREFERRED EMBODIMENTS

An exposure device in an image-forming machine constituted according to the present invention will now be described in detail with reference to the accompanying drawings.

Figure 1:
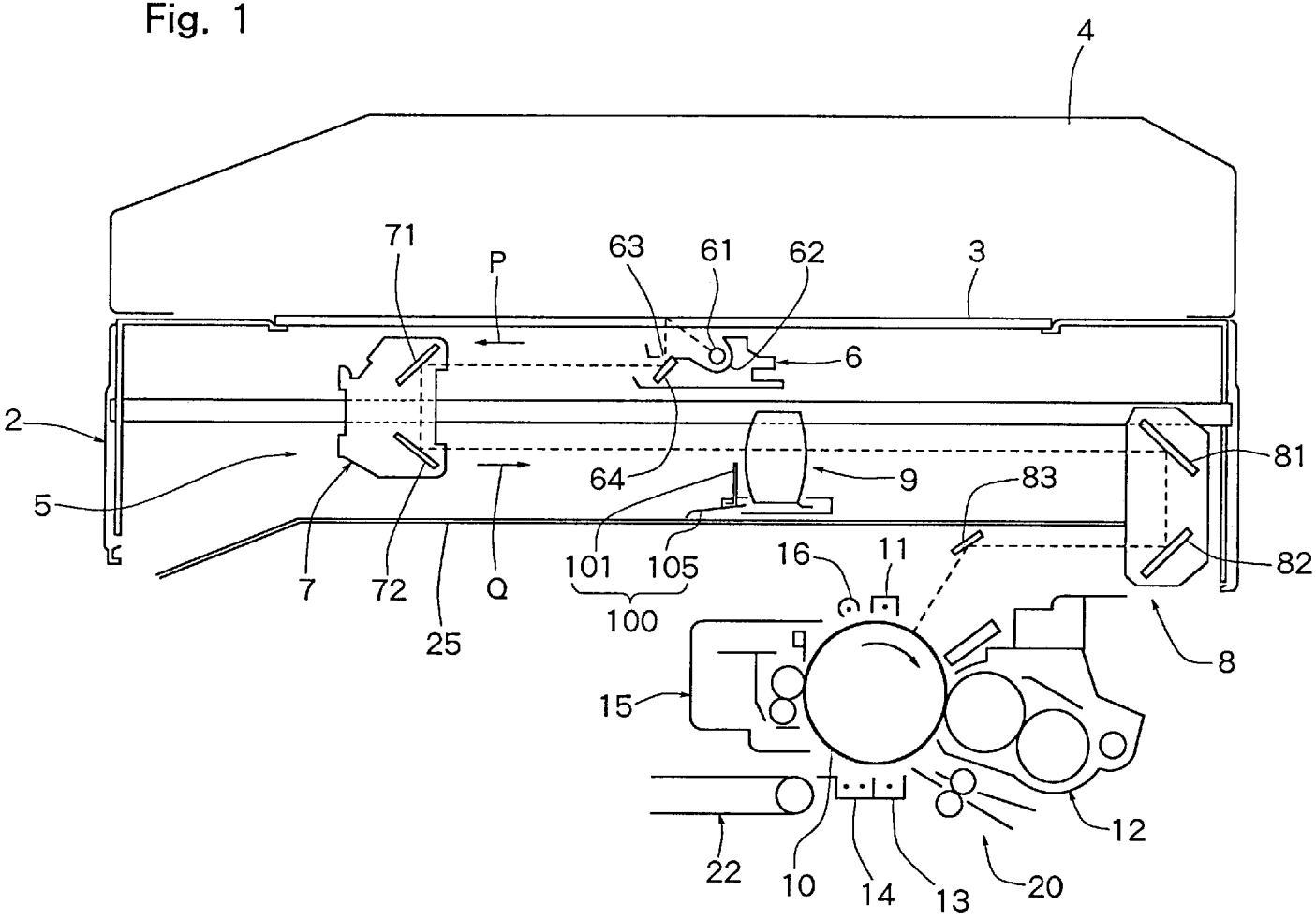
FIG. 1 is a sectional view schematically illustrating the constitution of an electrostatic copying machine, which is an image-forming machine equipped with an exposure device constituted according to the present invention.

FIG. 1 illustrates an electrostatic copying machine which is an image-forming machine provided with an exposure device constituted according to an embodiment of the present invention.

The illustrated electrostatic copying machine is equipped with a cubic machine housing 2. On the upper surface of the machine housing 2 are arranged a contact glass 3 on which will be placed a document that is to be copied, and a document-holding plate 4 which can be opened and closed to cover the document placed on the contact glass 3. An exposure device 5 is disposed on the lower side of the contact glass 3. The exposure device 5 comprises a first moving body 6 which reciprocatingly moves in a horizontal direction (right-and-left direction in FIG. 1) along the contact glass 3, a second moving body 7 which reciprocatingly moves in the direction of reciprocating motion of the first moving body 6 (right-and-left direction in FIG. 1) in synchronism with the reciprocating motion of the first moving body 6 at a speed of one-half the moving speed of the first moving body 6, a group of stationary mirrors 8, and an optical lens unit 9 disposed between the second moving body 7 and the group of stationary mirrors 8.

The first moving member 6 includes an illumination lamp 61 for illuminating the document placed on the contact glass 3, a reflector plate 62 for reflecting light from the illumination lamp 61 to the document placed on the contact glass 3, a slit 63 for exposure, and a first mirror 64 for projecting light reflected by the surface of the document through the slit 63 toward a direction indicated by an arrow P.

On the second moving body 7 are disposed a second mirror 71 and a third mirror 72. Light reflected by the first mirror 64 in the direction of arrow P is projected by the second mirror 71 and by the third mirror 72 toward a direction indicated by an arrow Q.

The group of stationary mirrors 8 includes a fourth mirror 81, a fifth mirror 82 and a sixth mirror 83. Light reflected by the third mirror 72 toward the direction of arrow Q and passed through the optical lens unit 9 is successively reflected by the fourth mirror 81, fifth mirror 82 and sixth mirror 83, and is projected onto the photosensitive surface of a photosensitive material drum 10.

The optical lens unit 9 is so constituted as to reciprocatingly move in the direction of optical axis (right-and-left direction in FIG. 1) so that the magnification of projection can be changed. The optical lens unit 9 will be described later in detail.

The photosensitive material drum 10 is arranged in the machine housing 2, maintaining freedom of rotation. The photosensitive material drum 10 is driven to rotate in a direction indicated by an arrow by a drive means that is not shown. The photosensitive material drum 10 is surrounded by a corona discharger 11 for electric charging, a developer unit 12, a corona discharger 13 for transfer, a corona discharger 14 for peeling, a cleaning unit 15, and a lamp 16 for removing electric charge, in the order mentioned as viewed in the direction of rotation indicated by the arrow.

Furthermore, the illustrated electrostatic copying machine is equipped with a transfer paper feeding device 20 for feeding a transfer paper into a transfer zone between the corona discharger 13 for transfer and the photosensitive material drum 10, and is further provided with a transfer paper conveyer belt mechanism 22 in the transfer zone for sending the transfer paper out.

In the thus constituted electrostatic copying machine, the corona discharger 11 electrostatically charges a photosensitive material on the photosensitive material drum 10 into a predetermined polarity substantially uniformly, the illumination lamp 61 illuminates the document placed on the contact glass 3, the reflected light image is scanningly exposed on the photosensitive material drum 10, travelling via the slit 63 for exposure, first mirror 64, second mirror 71, third mirror 72, optical lens unit 9, fourth mirror 81, fifth mirror 82 and sixth mirror 83, and an electrostatic latent image is formed on the photosensitive material drum 10 while the photosensitive material drum 10 rotates in the direction indicated by the arrow. Then, the electrostatic latent image on the photosensitive material drum 10 is developed by a developer unit 12 into a toner image. On the other hand, the transfer paper conveyed by the transfer paper feeding device 20 to the transfer zone passes between the photosensitive material drum 10 on which the toner image is formed and the corona discharger 13 for transfer, and the toner image is transferred onto the transfer paper The transfer paper onto which the toner image has been transferred is peeled from the photosensitive material drum 10 by the action of the corona discharger 14 for peeling, conveyed to a fixing unit (that is not shown) by the transfer paper conveyer belt mechanism 22, is thermally fixed and is discharged onto a discharge tray through a pair of discharge rollers (that are not shown). After the transfer step has been finished as described above, the toner adhering onto the outer peripheral surface of the photosensitive drum 10 is removed by the cleaning unit 15. Then, the surface of the photosensitive material is irradiated with light from the lamp 16, so that the electric charge is removed therefrom.

Next, the optical lens unit 9 according to the embodiment will be described with reference to FIGS. 2 to 6.

The optical lens unit 9 is equipped with a lens-holding plate 91. The lens-holding plate 91 has an elongated shape and has a cut-away recessed portion 91*a* formed in a central portion thereof. The lens-holding plate 91 is movably mounted at both of its ends (upper and lower ends in FIG. 2) on a pair of guide rails 92, 92 that extend in the machine housing 2 in the direction of the optical axis, indicated in FIG. 1 by the arrow Q. The thus constituted lens-holding plate 91 is caused to reciprocatingly move in the right-and-left direction in FIG. 2 by a lens-moving means 93.

The lens-moving means 93 is constituted by a wire-type transmission means 937 which comprises a stepping motor 931 which is a source of drive, a reduction gear 932 for reducing the speed of the stepping motor 931, a drive pulley 933 fitted to the output shaft of the reduction gear 932, a pair of pulleys 934 and 935 disposed along the guide rail 92, and an endless wire 936 which has one turn wound around the drive pulley 933 and then is wound around the pulleys 934 and 935. The endless wire 936 is connected to an end (upper end in FIG. 2) of the lens-holding plate 91.

Figure 2:
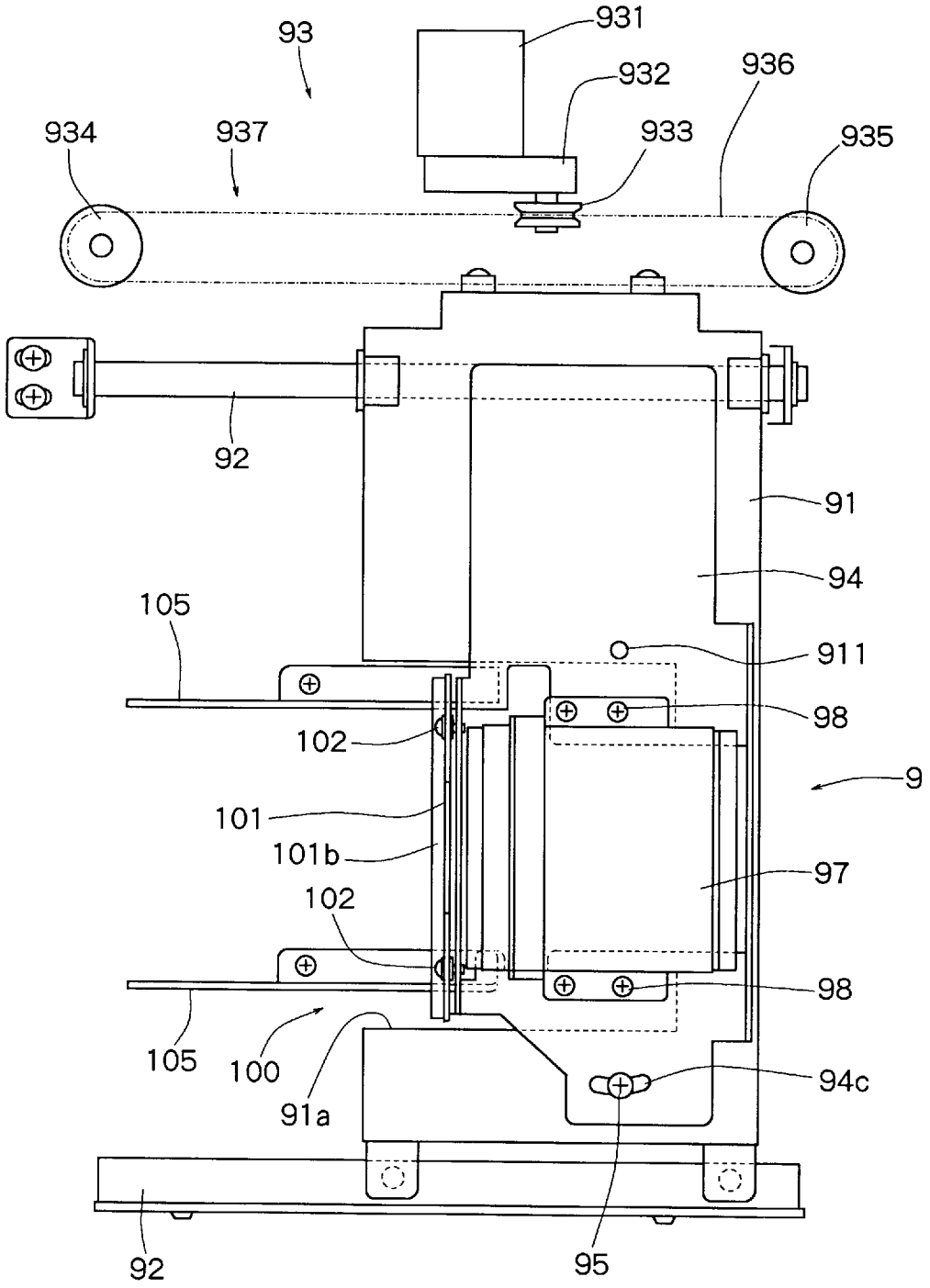
FIG. 2 is a plan view of major portions of the exposure device constituted according to an embodiment of the present invention.
Figure 5:
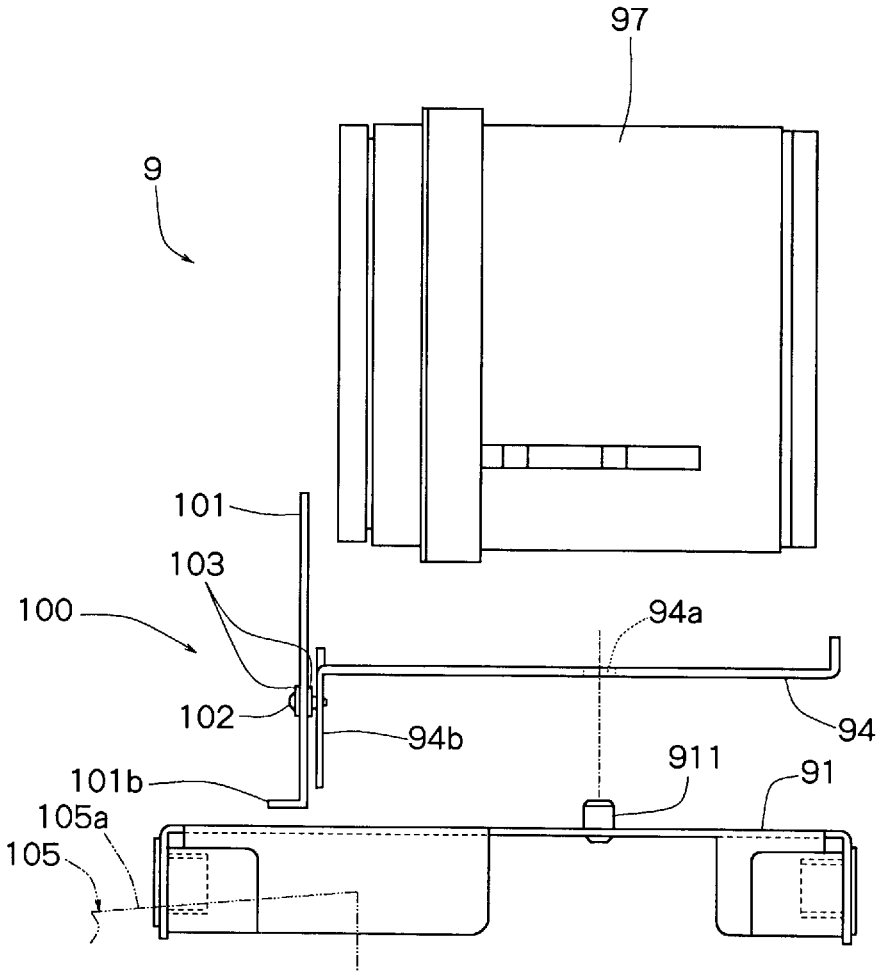
FIG. 5 is a side view illustrating, in a disassembled manner, an optical lens unit that constitutes the exposure device shown in FIG. 2.

A lens center-adjusting plate 94 is disposed on the lens-holding plate 91 that is caused to reciprocatingly move in the right-and-left direction in FIG. 2 by the lens-moving means 93. As shown in FIG. 5, the lens center-adjusting plate 94 has a hole 94*a* that corresponds to a positioning vertical shaft 911 that is upwardly disposed at the center of the lens-holding plate 91. Upon fitting the hole 94*a* to the positioning vertical shaft 911, the lens center-adjusting plate 94 is allowed to pivot on the positioning vertical shaft 911. Furthermore, the lens center-adjusting plate 94 has a mounting flange 94*b* that is downwardly bent on the left side (on the side of the third mirror 72) in FIG. 5, and an elongated arcuate hole 94*c* which has the positioning vertical shaft 911 as a center. A fixing screw 95, inserted in the elongated hole 94*c* formed in the lens center-adjusting plate 94, is screwed into a threaded hole formed in the lens-holding plate 91. When the fixing screw 95 is loosened, the lens center-adjusting plate 94 can be pivoted on the positioning vertical shaft 911 as a center. Upon fastening the fixing screw 95, the lens center-adjusting plate 94 is fixed to the lens-holding plate 91.

A lens frame 97, mounting a lens 96, is mounted on the lens center-adjusting plate 94 by a plurality of screws 98.

Figure 4:
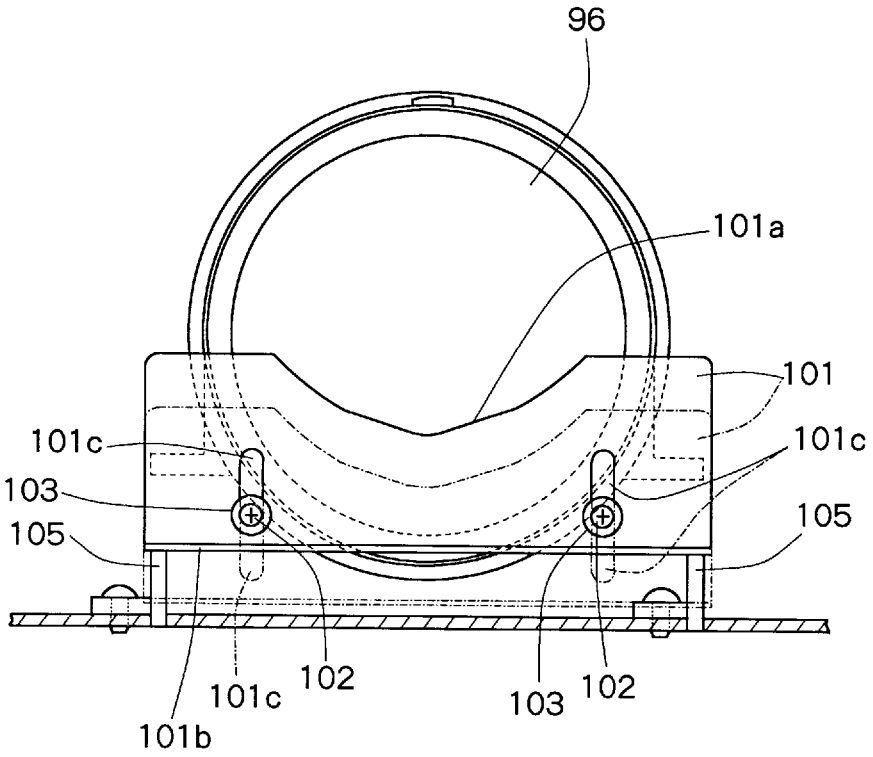
FIG. 4 is a front view illustrating major portions of the exposure device shown in FIG. 2.

On the mounting flange 94*b* of the lens center-adjusting plate 94 is mounted a light quantity correction plate 101 which constitutes part of a light quantity correction means 100. As shown in FIG. 4, the light quantity correction plate 101 has a cut-away recessed portion 101*a* formed in the upper central portion thereof and has, on the lower portion thereof, a placing portion 101*b* that is bent nearly horizontally. The light quantity correction plate 101 has two guide holes 101*c* and 101*c* extending in the up-and-down direction. Due to guide pins 102 and 102 passing through the guide holes 101*c* and 101*c*, and fitted to the mounting flange 94*b*, the light quantity correction plate 101 is mounted on the mounting flange 94*b* and is allowed to move upward and downward. Correction plate-holding members 103 and 103 are fitted to the guide pins 102 and 102 and so are arranged on both sides of the light quantity correction plate 101.

Figure 3:
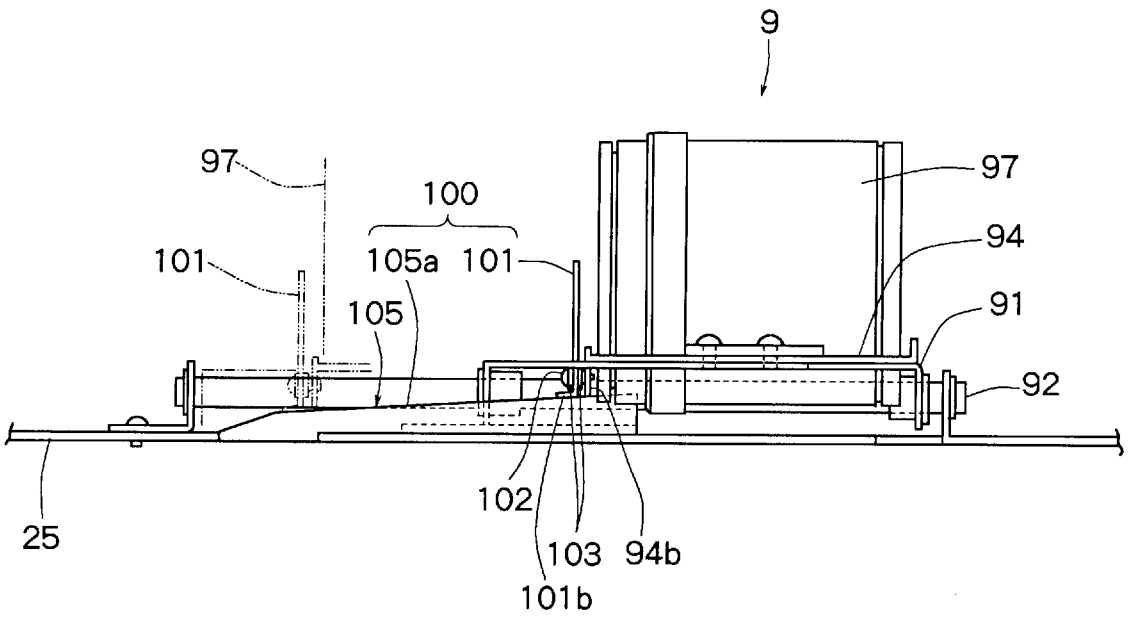
FIG. 3 is a side view illustrating major portions of the exposure device shown in FIG. 2.

Under the light quantity correction plate 101, a pair of inclined guide members 105 and 105 are arranged in parallel with the pair of guide rails 92 and 92 and, together with the light quantity correction plate 101, constitute the light quantity correction means 100. The pair of inclined guide members 105 and 105 are disposed on a base plate 25 that is provided in the machine housing 2 and have, on the upper surfaces thereof, inclined surfaces 105*a* and 105*a* that decline, as shown in FIG. 3, from the right side toward the left side (descending from the side of the lens 96 toward the side of the third mirror 72). The placing portion 101*b* of the light quantity correction plate 101 is placed on the inclined surfaces 105*a* and 105*a* of the pair of inclined guide members 105 and 105. Therefore, when the optical lens unit 9 reciprocatingly moves on the pair of guide rails 92, 92, the light quantity correction plate 101 slides on the inclined surfaces 105*a* and 105*a* of the pair of inclined guide members 105 and 105 to move up and down.

The exposure device in the image-forming machine according to the illustrated embodiment is constituted as described above. Described below is the operation.

Figure 6:
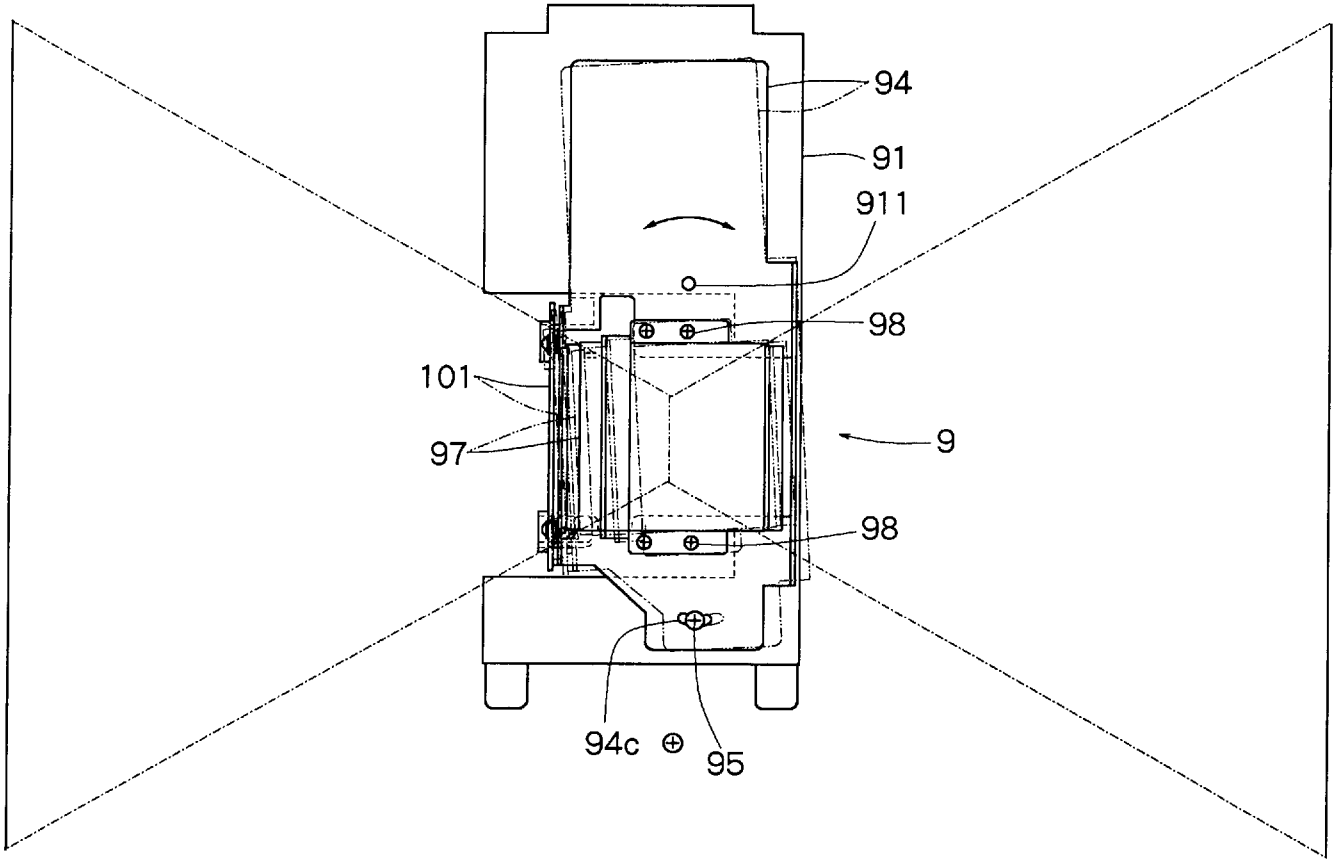
FIG. 6 is a diagram illustrating an example of adjusting the angle for mounting the lens of the optical lens unit that constitutes the exposure device shown in FIG. 2.

To adjust the angle for mounting the lens 96, the fixing screw 95 is loosened, the lens center-adjusting plate 94 is pivoted on the positioning vertical shaft 911, the angle for mounting the lens is selected by comparing the image of the front side with the image of the rear side, as illustrated in single-dotted chain lines in FIG. 6. Thereafter, the fixing screw 95 is tightened to fix the lens center-adjusting plate 94 onto the lens-holding plate 91. Thus the lens frame 97 mounting the lens 96 can be positioned, for example, as indicated by the two-dotted chain line in FIG. 6. Here, however, since the light quantity correction plate 101 is mounted on the mounting flange 94*b* of the lens center-adjusting plate 94, the light quantity correction plate 101, also, is positioned as indicated by the two-dotted chain line in FIG. 6 in conformity with adjusting the angle for mounting the lens. Even when the angle for mounting the lens is adjusted, therefore, the positional relationship between the light quantity correction plate 101 and the lens 96 does not change, and a predetermined positional relationship can be always maintained between the light quantity correction plate 101 and the lens 96.

Described below is the case when the lens 96 is moved in the direction of the optical axis based upon the data for setting a magnification that is variable.

When a drive signal consisting of a predetermined number of steps is output to the stepping motor 931 from a control means that is not shown in response to data for setting a magnification that is variable, the driving force of the stepping motor 931 is transmitted via the reduction gear 932 and drive pulley 933 to the endless wire 936, which is wound round the pulleys 934 and 935. As a consequence, the endless wire 936, which is connected to an end of the lens-holding plate 91 is caused to move toward the right or toward the left in FIG. 2. Therefore, the lens-holding plate 91 is caused to move toward the right or toward the left in FIGS. 2 and 3 on the pair of guide rails 92 and 92 that are extending in the direction of optical axis. When the magnification of projection is to be decreased, the lens-holding plate 91 moves toward the right in FIGS. 2 and 3, and thus toward the solid line position of FIG. 3. When the magnification of projection is to be increased, the lens-holding plate 91 moves toward the left in FIGS. 2 and 3 and thus toward the two-dotted chain line position of FIG. 3.

When the lens-holding plate 91 moves in the direction for decreasing the magnification of projection (toward the right in FIGS. 2 and 3), the light quantity correction plate 101, mounted on the center-adjusting plate 94 which is placed on the lens-holding plate 91, slides on the inclined surfaces 105*a* and 105*a* of the pair of the inclined guide members 105 and moves upwards toward the position depicted in solid lines in FIG. 4, being guided by the guide pins 102 and 102. Therefore, the quantity of light projected to the slit exposure area in the lengthwise direction thereof is limited by the light quantity correction plate 101, and the cut-away recessed portion 101*a* in the upper central portion thereof that is raised in the radial direction toward the center of the lens 96 on the front surface of the lens.

When the lens-holding plate 91 moves in the direction for increasing the magnification of projection (toward the left in FIGS. 2 and 3), on the other hand, the light quantity correction plate 101 slides on the inclined surfaces 105*a* and 105*a* of the pair of inclined guide members 105, and moves downwards toward the position depicted in single-dotted chain lines in FIG. 4, being guided by the guide pins 102 and 102. Therefore, the quantity of light that is projected is limited by the light quantity correction plate 101 to be decreased.

In the exposure device shown in FIGS. 1 to 6, the light quantity correction plate 101 is disposed on the upstream side of the lens 96, i.e., on the side of the third mirror 72. The light quantity correction plate 101, however, may be disposed on the downstream side of the lens 96, i.e., on the side of the fourth mirror 81.

Figure 7:
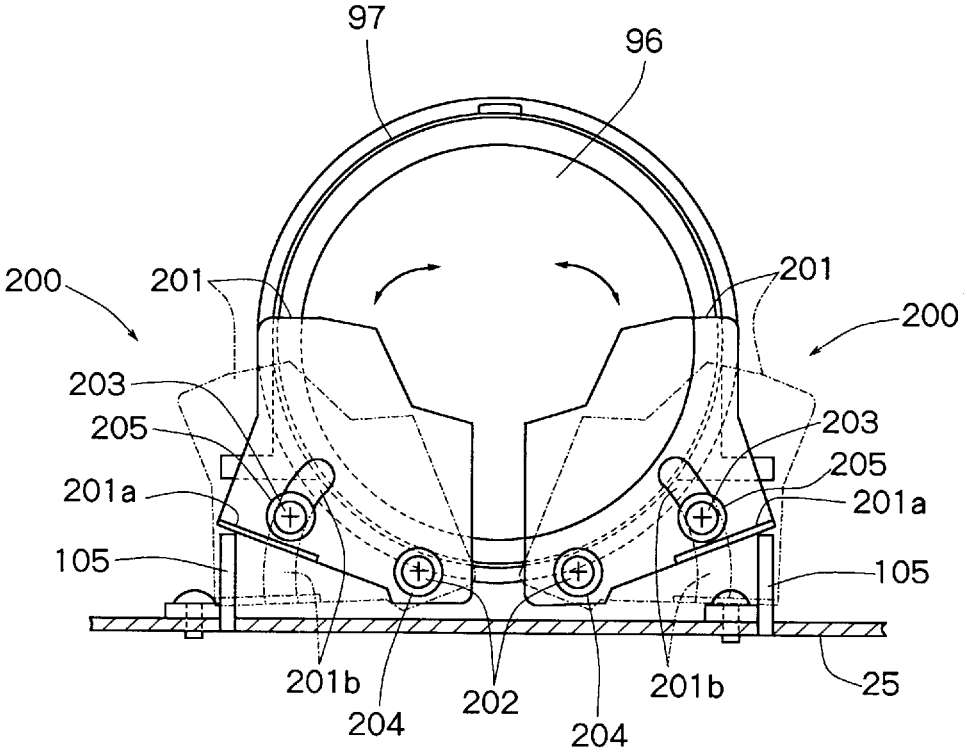
FIG. 7 is a front view illustrating major portions of the exposure device constituted according to another embodiment of the present invention.
Figure 8:
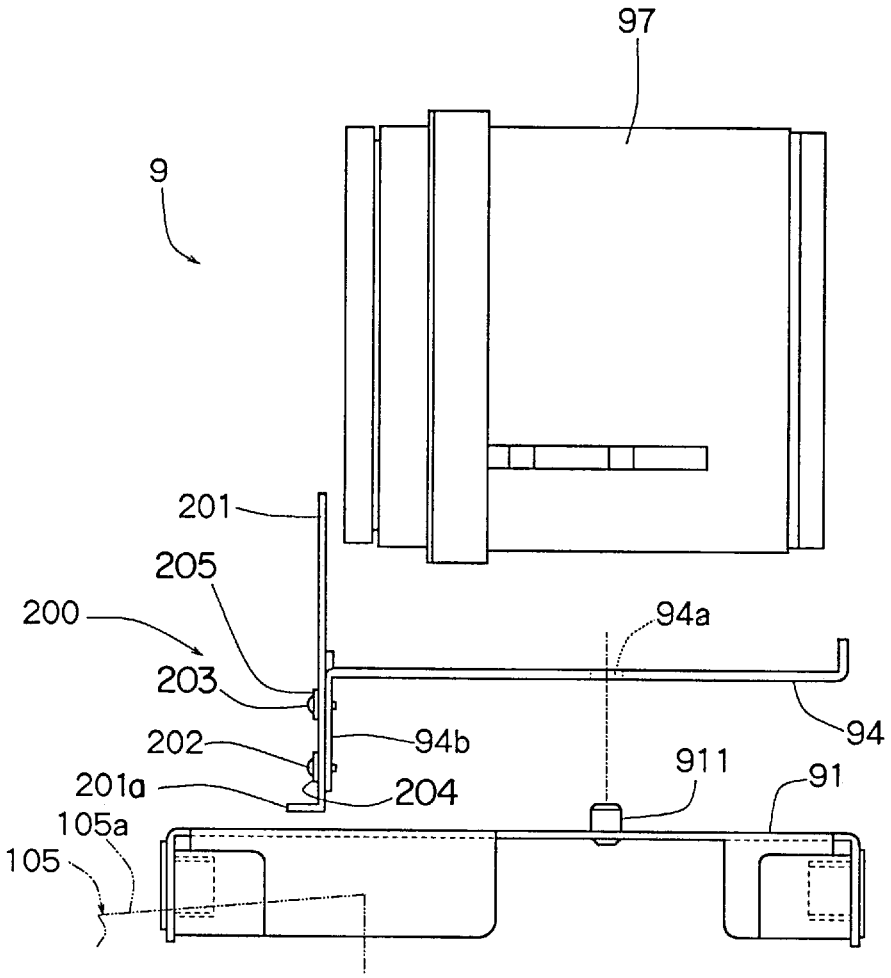
FIG. 8 is a side view illustrating, in a disassembled manner, the optical lens unit that constitutes the exposure device shown in FIG. 7.

Described below with reference to FIGS. 7 and 8 is the exposure device in the image-forming machine according to another embodiment. The exposure device shown in FIGS. 7 and 8 is substantially the same as that of the above-mentioned embodiment, except for the constitution of the light quantity correction plates and the mounting construction. Therefore, the same members are denoted by the same reference numerals, and their description is not repeated.

In this embodiment, a light quantity correction means 200 is equipped with a pair of light quantity correction plates 201 and 201. The pair of light quantity correction plates 201 and 201 have low upper edges on the inner sides that are opposed to each other and have high upper edges on the outer sides. The pair of light quantity correction plates 201 and 201 further have placing portions 201*a* and 201*a*, formed by bending the lower portions of the outer sides, as well as arcuate guide holes 201*b* and 201*b*.

The thus constituted pair of light quantity correction plates 201 and 201 are pivotably supported by support shafts 202, 202 that are mounted on the central portion of the mounting flange 94*b* of the lens center-adjusting plate 94. Support shafts 202 pass through shaft holes (not shown) formed at the center positions of the radius of the arcuate guide holes 201*b*, 201*b* in the inner lower portions of the light quantity correction plate 201, 201, the support shafts 202 and 202 protruding in the direction of optical axis. The swinging motion of the pair of the light quantity correction plates 201 and 201 is guided by guide pins 203 and 203 which are fitted to the mounting flange 94*b* and pass through the arcuate guide holes 201*b*, 201*b*. The correction plate-holding members 204, 204 and 205, 205 are disposed between the pair of light quantity correction plates 201, 201 and the heads of the support shafts 202, 202 and between the pair of light quantity correction plates 201, 201 and the heads of the guide pins 203, 203, the correction plate-holding members 204, 204 and 205, 205 being respectively fitted to the support shafts 202, 202 and to the guide pins 203, 203. Thus, the pair of light quantity correction plates 201, 201, which are pivotably supported by the support shafts 202, 202 are placed, at their placing portions 201*a*, 201*a* formed by bending the outer lower portions thereof, on the inclined surfaces 105*a*, 105*a* of the pair of inclined guide members 105, 105.

The exposure device shown in FIGS. 7 and 8 is constituted as described above. Described below is the operation of that exposure device when the lens 96 is moved in the direction of the optical axis based upon the data for setting a magnification that is variable.

When the lens-holding plate 91 moves in the direction of decreasing the magnification of projection (toward the right in FIG. 8), the pair of light quantity correction plates 201, 201, mounted on the center-adjusting plate 94 which is placed on the lens-holding plate 91, pivot on the support shafts 202 and 202 as centers so as to approach the center of the lens as depicted in solid line in FIG. 7, while sliding on the inclined surfaces 105*a* and 105*a* of the pair of inclined guide members 105. Therefore, light projected toward the lens 96 is partly shut off by the pair of light quantity correction plates 201 and 201, and the quantity of light projected onto the slit exposure area in the lengthwise direction thereof is decreased.

When the lens-holding plate 91 moves in the direction for increasing the magnification of projection (toward the left in FIG. 8), on the other hand, the pair of light quantity correction plates 201 and 201 pivot on the support shafts 202 and 202 as centers so as to separate away from the center of the lens, as depicted in single-dotted chain lines in FIG. 7, while sliding on the inclined surfaces 105*a*, 105*a* of the pair of inclined guide members 105. Therefore, the amount of the light projected toward the lens 96 that is blocked by the pair of light quantity correction plates 201 and 201 is decreased, and the quantity of light projected onto the slit exposure area in the lengthwise direction is controlled.

According to this embodiment as described above, the pair of light quantity correction plates 201, 201 are so constituted as to pivot on the support shafts 202, 202, featuring smooth motion compared to that of the light quantity correction plate 101 of the above-mentioned embodiment. This helps decrease the drive load for moving the optical lens unit 9 in the direction of the optical axis.

In this embodiment, furthermore, the pair of light quantity correction plates 201, 201 are so constituted as to pivot on the support shafts 202, 202. Therefore, the light quantity correction plates are not tilted even when the amount of operation is increased, but smoothly pivot on the support shafts 202 and 202. Thus, this embodiment makes it possible to increase the amount of operation of the pair of light quantity correction plates 201, 201 and, hence, to accomplish the correction of light quantity to a sufficient degree.

In the exposure device shown in FIGS. 7 and 8, the pair of light quantity correction plates 201, 201 are mounted on the mounting flange 94*b* of the lens center-adjusting plate 94 on which the lens is mounted. Therefore, even when the lens center-adjusting plate 94 is turned on the positioning vertical shaft 911 to adjust the angle for mounting the lens, the positional relationship between the pair of light quantity correction plates 201, 201 and the lens does not change, and a predetermined positional relationship is maintained at all times between the pair of light quantity correction plates 201, 201 and the lens.

What we claim is:

1. An exposure device for an image-forming machine, the image forming machine including a photosensitive material member having a photosensitive surface, said exposure device comprising:

a lens-holding plate adapted to be mounted on the image-forming machine for reciprocating movement thereon;

a lens center-adjusting plate pivotally disposed on said lens-holding plate for reciprocating movement therewith and for pivoting about a positioning vertical shaft while being able to be secured non-pivotally thereon;

a lens having an optical axis and mounted on said lens center-adjusting plate for pivoting therewith and for reciprocating movement therewith in a direction parallel to the optical axis;

a light quantity correction plate mounted on said lens center-adjusting plate and movable in a radial direction of said lens; and a guide member for causing said light quantity correction plate to move in the radial direction of said lens upon reciprocating movement of said lens-holding plate in the direction of the optical axis.

2. An exposure device for an image-forming machine, the image-forming machine including a photosensitive material member having a photosensitive surface, said exposure device comprising:

a lens-holding plate adapted to be mounted on the image-forming machine for reciprocating movement thereon;

a lens having an optical axis and mounted on said lens-holding plate for reciprocating movement therewith in a direction parallel to the optical axis;

a pair of support shafts mounted on said lens-holding plate for reciprocating movement therewith and extending in the direction of the optical axis;

a pair of light quantity correction plates supported by said pair of support shafts for pivotal movement in a plane substantially normal to the optical axis and for reciprocating movement with said lens-holding plate; and a guide member for causing said pair of light quantity correction plates to pivot about said pair of support shafts upon reciprocating movement of said lens-holding plate in the direction of the optical axis.

3. An exposure device according to claim 2, wherein said pair of light quantity correction plates have arcuate guide holes, the arcs of which have said pair of support shafts as centers, and wherein said exposure device further comprises a pair of guide pins fitted to said lens center-adjusting plate and passing through said arcuate guide holes to guide the pivoting of said pair of light quantity correction plates.

4. An exposure device for an image-forming machine, the image-forming machine including a photosensitive material member having a photosensitive surface, said exposure device comprising:

a lens-holding plate adapted to be mounted on the image-forming machine for reciprocating movement thereon;

a lens center-adjusting plate mounted on said lens-holding plate for reciprocating movement therewith and for pivoting about a positioning vertical shaft while being able to be secured non-pivotally thereon;

a lens having an optical axis and mounted on said lens center-adjusting plate for pivoting therewith and for reciprocating movement therewith in a direction parallel to the optical axis;

a pair of support shafts mounted on said lens center adjusting plate for reciprocating and pivotal movement therewith and extending in the direction of the optical axis;

a pair of light quantity correction plates supported by said pair of support shafts for pivotal movement in a plane substantially normal to the optical axis and for reciprocating movement with said lens center-adjusting plate; and a guide member for causing said pair of light quantity correction plates to pivot on said pair of support shafts upon reciprocating movement of said lens-holding plate in the direction of the optical axis, so as to move said pair of light quantity correction plates in a plane substantially normal to the optical axis.

5. An exposure device according to claim 4, wherein said pair of light quantity correction plates have arcuate guide holes, the arcs of which have said pair of support shafts as centers, and wherein said exposure device further comprises a pair of guide pins fitted to said lens center-adjusting plate and passing through said arcuate guide holes to guide the pivoting of said pair of light quantity correction plates.

6. An exposure device for an image-forming machine, the image-forming machine including a photosensitive material member having a photosensitive surface, said exposure device comprising:

a lens-holding plate adapted to be mounted on the image-forming machine for reciprocating movement thereon;

a lens having an optical axis and mounted on said lens-holding plate for reciprocating movement therewith in a direction parallel to the optical axis;

at least one light quantity correction plate mounted on said lens-holding plate for movement in a plane substantially normal to the optical axis and for reciprocating movement with said lens-holding plate; and a guide member for causing said at least one light quantity correction plate to move in said plane upon reciprocating movement of said lens-holding plate in the direction of the optical axis.

7. An exposure device according to claim 6, wherein said at least one light quantity correction plate is mounted for translational movement in said plane.

8. An exposure device according to claim 6, wherein said at least one light quantity correction plate is mounted for arcuate movement in said plane.

* * * * *